US012193568B1

(12) United States Patent
McIrvin

(10) Patent No.: US 12,193,568 B1
(45) Date of Patent: Jan. 14, 2025

(54) CONFIGURABLE MAGNETIC DIVIDERS FOR A STORAGE RECEPTACLE

(71) Applicant: Stephen F. McIrvin, Blacksburg, VA (US)

(72) Inventor: Stephen F. McIrvin, Blacksburg, VA (US)

( * ) Notice: Subject to any disclaimer, the term of this patent is extended or adjusted under 35 U.S.C. 154(b) by 0 days.

(21) Appl. No.: 18/672,567

(22) Filed: May 23, 2024

(51) Int. Cl.
*A47B 88/975* (2017.01)

(52) U.S. Cl.
CPC ..... *A47B 88/975* (2017.01)

(58) Field of Classification Search
CPC ..... A47B 88/975; B42F 17/12
USPC ..... 312/348.3; 220/529
See application file for complete search history.

(56) References Cited

U.S. PATENT DOCUMENTS

| | | | | |
|---|---|---|---|---|
| 8,317,040 | B2 | 11/2012 | Lanning | |
| 11,376,516 | B2 | 7/2022 | Kogure | |
| 11,527,344 | B2 | 12/2022 | Kuo | |
| 2001/0004817 | A1 * | 6/2001 | Auer | E04B 2/7438 52/239 |
| 2014/0210331 | A1 * | 7/2014 | Tunzi | F25D 25/00 29/428 |
| 2022/0287460 | A1 | 9/2022 | Guzeltepe et al. | |

FOREIGN PATENT DOCUMENTS

| | | | | |
|---|---|---|---|---|
| CN | 102679681 | A | 9/2012 | |
| CN | 213550660 | U | 6/2021 | |
| CN | 213720833 | U | 7/2021 | |
| CN | 216422508 | U | 5/2022 | |
| CN | 217792027 | U | 11/2022 | |
| CN | 220299078 | U | 1/2024 | |
| DE | 3343098 | A1 | 6/1985 | |
| DE | 202004010776 | U1 | 7/2005 | |
| DE | 102010023408 | A1 | 12/2011 | |
| DE | 202012004344 | U1 | 6/2012 | |
| DE | 202017106273 | U1 | 10/2017 | |
| EP | 3936208 | * | 1/2022 | A63H 33/00 |
| JP | 2016214533 | A | 12/2016 | |
| JP | 2020085059 | A | 6/2020 | |
| JP | 6854010 | B2 | 3/2021 | |
| KR | 20200001329 | A | 1/2020 | |
| KR | 20230087035 | A | 6/2023 | |
| KR | 102619469 | B1 | 1/2024 | |

* cited by examiner

*Primary Examiner* — James O Hansen
(74) *Attorney, Agent, or Firm* — Innovation Law Office; Dennis S. Schell

(57) ABSTRACT

A magnetic divider system for a storage receptacle including a plurality of elongate panels. Each panel may include a pair of bands of magnetic material, for example steel, extending along the length of the panel. Each panel may also include a pair of magnets located at each end and arranged to magnetically attract and attach to the pair of magnetic material bands when the end of a first panel is butted against the side of a second panel. The panels may optionally include a layer to cover the sides and/or ends of the panel, Including the magnets and magnetic material bands, for example a veneer or other material. Panels may be different lengths and a uniform height to provide a desired configuration of some sub compartments within a storage receptacle, for example a drawer, cabinet, shelf, container, and the like.

20 Claims, 8 Drawing Sheets

CONFIGURABLE MAGNETIC DIVIDERS FOR A STORAGE RECEPTACLE

TECHNICAL FIELD

Embodiments of this disclosure relate generally to organization systems for storage receptacles, and more particularly to dividers that can be installed into a storage receptacle to form sub-compartments to separate and organize contents in the storage receptacle.

BACKGROUND

Organizing storage space within a storage receptacle such as a drawer, a container, shelving, a cabinet, a vehicle console or trunk, or the like is generally limited to using fixed dividers that are already formed into sub-compartments or that are configurable but only with pre-cut interlocking slots that substantially limit the available configurations. Such dividers thus only provide only a single configuration or very limited preset sizes for the sub-compartments formed in the storage receptacle by the dividers. The utility of such dividers is thus limited as the sub-compartments formed by the dividers acting as interlocked barriers cannot be uniquely sized to match the contents desired to be stored in the storage receptacle.

One prior art device using magnets to interlock dividers only provides for magnetic attraction between the ends of adjacent dividers. Another prior art device using magnets requires that the storage container metal or to have a metal sheet spanning the full length and width of the storage container.

However, it was realized by the inventor of the current disclosure that the limited configurations of sub-compartments, the lack of dividers for use with non-metallic storage receptacles, and/or having to choose between a non-configurable but sturdy divider system or a configurable but non-sturdy divider system that doesn't maintain its configuration fails to provide a user with the desired flexibility in configuring the dividers within a storage receptacle and in maintaining the configuration once selected. Certain features of the present disclosure address these and other needs and provide other important advantages.

SUMMARY

Embodiments of the present disclosure provide a divider system for a storage receptacle including a plurality of elongate panels. Each panel may include a pair of bands of magnetic material, for example steel, extending along the length of the panel. Each panel may also include a pair of magnets located at each end and arranged to magnetically attract and attach to the pair of magnetic material bands when the end of a first panel is butted against the side of a second panel. The panels may optionally include a layer to cover the sides and/or ends of the panel, Including the magnets and magnetic material bands, for example a veneer or other material. Panels may be different lengths and a uniform height to provide a desired configuration of sub-compartments within a storage receptacle, for example a drawer, a container, shelving, a cabinet, a vehicle console or trunk, or the like.

In accordance with one embodiment of the present disclosure, a divider system for a storage receptacle, comprises a plurality of elongate panels; and wherein each of the plurality of elongate panels includes: a first band of magnetic material extending along the length of each of the plurality of elongate panels at a first distance from a bottom edge of each of the plurality of elongate panels; a second band of magnetic material extending along the length of each of the plurality of elongate panels at a second distance from the bottom edge of each of the plurality of elongate panels; at least a first magnet located at a first end of each of the plurality of elongate panels and positioned to magnetically attract at least one of the first band and the second band of magnetic material of a first one of the plurality of elongate panels; and at least a second magnet located at a second end of the one of the plurality of elongate panels and positioned to magnetically attract at least one of the first band and the second band of magnetic material of a second one of the plurality of elongate panels; and wherein a third one of the plurality of elongate panels positioned perpendicular to the first one and the second one of the plurality of elongate panels with the first end abutted against a side of the first one of the plurality of elongate panels and the second end abutted against a side of the second one of the plurality of elongate panels, the first one, the second one, and the third one of the plurality of elongate panels are magnetically retained in their relative positions to form a storage sub-compartment barrier within the storage receptacle.

Optionally, the divider system, wherein: the at least a first magnet includes a first pair of magnets, a first one of the first pair of magnets positioned at the first distance from the bottom edge of each of the plurality of elongate panels, and the second one of the first pair of magnets positioned at the second distance from the bottom edge of each of the plurality of elongate panels; and the at least a second magnet includes a second pair of magnets, a first one of the second pair of magnets positioned at the first distance from the bottom edge of each of the plurality of elongate panels and a second one of the second pair of magnets positioned at the second distance from the bottom edge of each of the plurality of elongate panels.

Optionally, the divider system, wherein the plurality of elongate panels are of uniform height, uniform thickness, and varying lengths. Optionally, wherein the first distance is about one-third of the height of the first one of the plurality of elongate panels. Optionally, wherein the second distance is about two-thirds of the height of the first one of the plurality of elongate panels. Optionally, wherein at least one of the first band and the second band of magnetic material comprises a continuous strip of magnetic material. Optionally, wherein at least one of the first band and the second band of magnetic material comprises a plurality of periodically spaced segments of magnetic material with spaces lacking magnetic material defined therebetween. Optionally, wherein at least one of the first band and the second band of magnetic material extends to opposites sides of each of the plurality of elongate panels. Optionally, the divider system of claim 1, wherein: at least one of the first band and the second band of magnetic material includes a first magnetic material component abutting a first side of each of the plurality of elongate panels and a second magnetic material component abutting a second side of each of the plurality of elongate panels; and a space lacking magnetic material is defined between the first magnetic material component and the second magnetic material component. Optionally, wherein: the first band and the second band of the magnetic material are recessed within each of the plurality of elongate panels; and each of the plurality of elongate panels defines opposite sides that are each planar and a surface of the first band and a surface of the second band of the magnetic material are flush with their respective opposite side.

Optionally, wherein: the at least a first magnet and the at least a second magnet are recessed within opposite ends of each of the plurality of elongate panels; and each of the plurality of elongate panels defines opposite ends that are each planar and a surface of the at least a first magnet and a surface of the at least a second magnet are each flush with their respective opposite end. Optionally, wherein the first band and the second band of magnetic material are magnetized to provide a persistent magnetic field. Optionally, wherein the at least a first magnet and the at least a second magnet of the first one of the plurality of elongate panels are oriented to magnetically attract the first band and the second band of magnetic material of the second one of the plurality of elongate panels.

Optionally, the divider system, wherein each of the plurality of elongate panels includes a cover layer spanning at least one of a side and an end of each of the plurality of elongate panels. Optionally, wherein the cover layer is a veneer. Optionally, wherein the cover layer spans at least the first band and the second band of magnetic material. Optionally, wherein each of the plurality of elongate panels includes an end cap enclosing the at least the first magnet at the first end. Optionally, wherein each of the plurality of elongate panels includes a friction layer spanning a bottom edge of each of plurality of elongate panels. Optionally, wherein the first one of the plurality of elongate panels includes a third band of magnetic material extending along the length of the first one of the plurality of elongate panels at a third distance from a bottom edge of the first one of the plurality of elongate panels.

Another illustrative embodiment according to the present disclosure includes a divider system for a storage receptacle, comprising a plurality of elongate panels; and wherein each of the plurality of elongate panels includes: a first band of magnetic material extending along the length of each of the plurality of elongate panels at a first distance from a bottom edge of each of the plurality of elongate panels; a second band of magnetic material extending along the length of each of the plurality of elongate panels at a second distance from the bottom edge of each of the plurality of elongate panels; a first pair of magnets, a first one of the first pair of magnets positioned at the first distance from the bottom edge of each of the plurality of elongate panels, and the second one of the first pair of magnets positioned at the second distance from the bottom edge of each of the plurality of elongate panels; and a second pair of magnets, a first one of the second pair of magnets positioned at the first distance from the bottom edge of each of the plurality of elongate panels and a second one of the second pair of magnets positioned at the second distance from the bottom edge of each of the plurality of elongate panels; and wherein: the first band and the second band of the magnetic material are recessed within each of the plurality of elongate panels; each of the plurality of elongate panels defines opposite sides that are each planar and a surface of the first band and a surface of the second band of the magnetic material are flush with their respective opposite side; the first pair of magnets and the second pair of magnets are recessed within their respective opposite end of each of the plurality of elongate panels; and each of the plurality of elongate panels defines opposite ends that are each planar and surfaces of the first pair of magnets and surfaces of the second pair of magnets are each flush with their respective opposite end. Optionally, wherein each of the plurality of elongate panels includes a cover layer spanning at least one of a side and an end of each of the plurality of elongate panels.

Yet another illustrative embodiment of the present disclosure includes a divider system for a storage receptacle, comprising a plurality of elongate panels; and wherein: a first one of the plurality of elongate panels includes: a first band of magnetic material extending along the length of the first one of the plurality of elongate panels at a first distance from a bottom edge of the first one of the plurality of elongate panels; and a second band of magnetic material extending along the length of the first one of the plurality of elongate panels at a second distance from the bottom edge of the first one of the plurality of elongate panels; and a second one of the plurality of elongate panels includes: at least a first magnet located at a first end of the second one of the plurality of elongate panels and positioned to magnetically attract at least one of the first band and the second band of magnetic material of a first one of the plurality of elongate panels; and at least a second magnet located at a second end of the second one of the plurality of elongate panels and positioned to magnetically attract at least one of the first band and the second band of magnetic material of a second one of the plurality of elongate panels; and wherein: the first band and the second band of the magnetic material are recessed within the first one of the plurality of elongate panels; each of the plurality of elongate panels defines opposite sides that are each planar and a surface of the first band and a surface of the second band of the magnetic material are flush with their respective opposite side; the first pair of magnets and the second pair of magnets are recessed within their respective opposite end of the second one of the plurality of elongate panels; each of the plurality of elongate panels defines opposite ends that are each planar and surfaces of the first pair of magnets and surfaces of the second pair of magnets are each flush with their respective opposite end; and the second one of the plurality of elongate panels positioned perpendicular to the first one of the plurality of elongate panels with the first end abutted against a side of the first one of the plurality of elongate panels, the first one and the second one of the plurality of elongate panels are magnetically retained in their relative positions to form a storage sub-compartment barrier within the storage receptacle.

Another illustrative embodiment of the present disclosure includes a storage receptacle adapted for use with a magnetic divider system of elongate panels to provide sub-compartments, and comprises a pair of sides and a pair of ends defining a compartment of the storage receptacle, and wherein: a first band of magnetic material extends the length of at least one of the pair of sides and at least one of the pair of ends at a first distance from a bottom edge of each of the at least one of the pair of sides and the at least one of the pair of ends; and a second band of magnetic material extends the length of the at least one of the pair of sides and the at least one of the pair of ends at a second distance from a bottom edge of each of the at least one of the pair of sides and the at least one of the pair of ends.

Optionally, the storage receptacle wherein the first band and the second band of the magnetic material are recessed within the at least one of the pair of sides and the at least one of the pair of ends such that a surface of each of the first band and the second band of the magnetic material are flush with the surface of the at least one of the pair of sides and the at least one of the pair of ends. Optionally, wherein each of the at least one of the pair of sides and the at least one of the pair of ends includes a cover layer spanning over at least the first band and the second band of the magnetic material. Optionally, wherein at least one of the first band and the second band of magnetic material comprises a plurality of periodically spaced segments of magnetic material with spaces lacking magnetic material defined therebetween. Optionally, wherein the first distance is about one-third of the height of the elongate panels and the second distance is about two-thirds of the height of the elongate panels. Optionally, wherein the first band and the second band of magnetic material are magnetized to provide a persistent magnetic field.

This summary is provided to introduce a selection of the concepts that are described in further detail in the detailed description and drawings contained herein. This summary is not intended to identify any primary or essential features of the subject matter. Some or all of the described features may be present in the corresponding independent or dependent claims, but should not be construed to be a limitation unless expressly recited in a particular claim. Each embodiment described herein does not necessarily address every object described herein, and each embodiment does not necessarily include each feature described. Other forms, embodiments, objects, advantages, benefits, features, and aspects of the present disclosure will become apparent to one of skill in the art from the detailed description and drawings contained herein. Moreover, the various apparatuses and methods described in this summary section, as well as elsewhere in this application, can be expressed as a large number of different combinations and subcombinations. All such useful, novel, and inventive combinations and subcombinations are contemplated herein, it being recognized that the explicit expression of each of these combinations is unnecessary.

BRIEF DESCRIPTION OF THE DRAWINGS

Some of the figures shown herein may include dimensions or may have been created from scaled drawings. However, such dimensions, or the relative scaling within a figure, are by way of example, and not to be construed as limiting.

DETAILED DESCRIPTION OF THE ILLUSTRATED EMBODIMENTS

Figure 1:
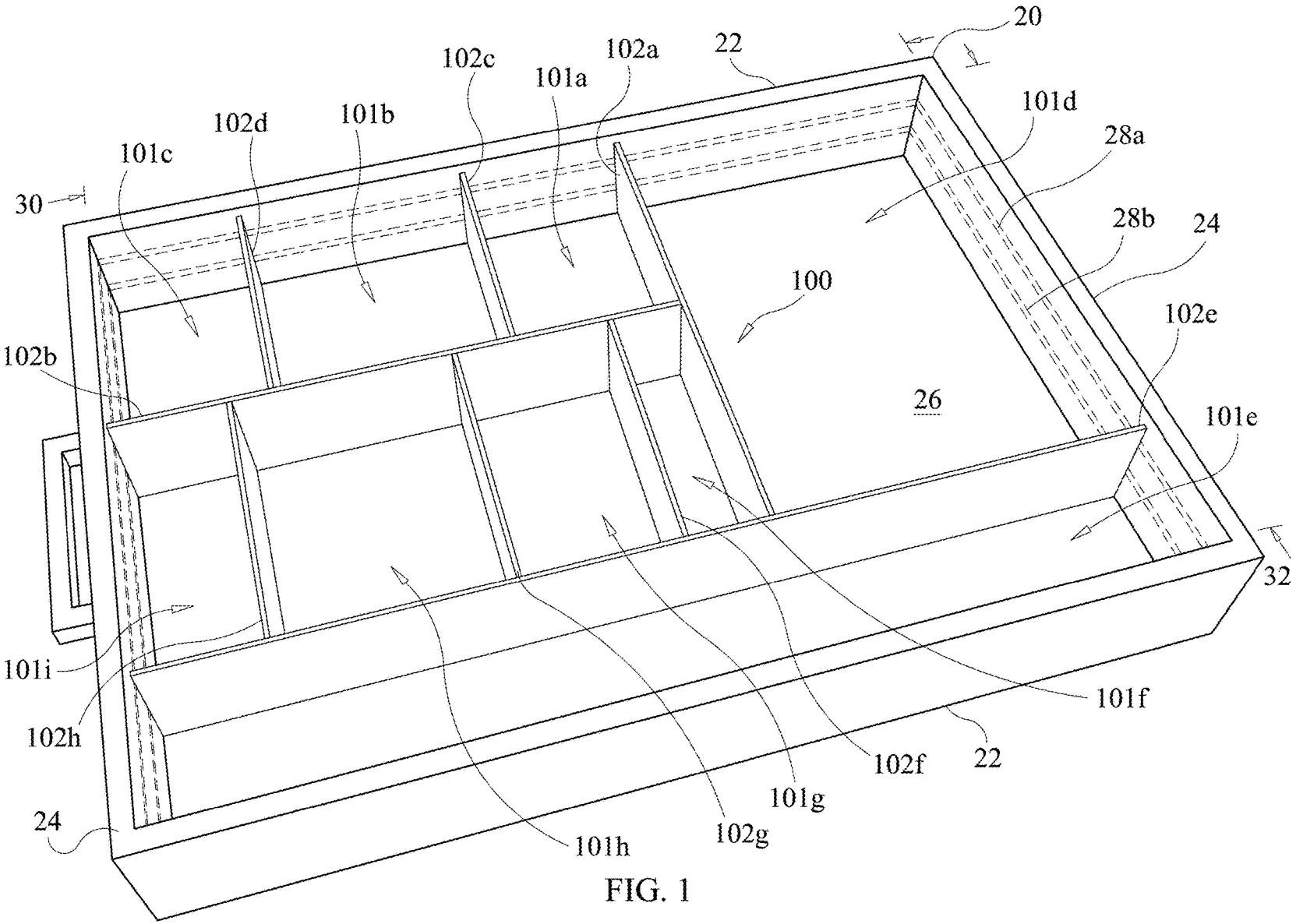
FIG. 1 is perspective view of a first embodiment of the divider system in use with a drawer storage receptacle that is adapted for use with the divider system.

For the purpose of promoting an understanding of the principles of the disclosure, reference will now be made to one or more embodiments, which may or may not be illustrated in the drawings, and specific language will be used to describe the same. It will nevertheless be understood that no limitation of the scope of the disclosure is thereby intended; any alterations and further modifications of the described or illustrated embodiments, and any further applications of the principles of the disclosure as illustrated herein are contemplated as would normally occur to one skilled in the art to which the disclosure relates. At least one embodiment of the disclosure is shown in detail, although it will be apparent to those skilled in the relevant art that some features or some combinations of features may not be shown for the sake of clarity and brevity.

Any reference to "invention" within this document is a reference to an embodiment of a family of inventions, with no single embodiment including features that are necessarily included in all embodiments, unless otherwise stated. Furthermore, although there may be references to benefits or advantages provided by some embodiments, other embodiments may not include those same benefits or advantages, or may include different benefits or advantages. Any benefits or advantages described herein are not to be construed as limiting to any of the claims.

The embodiments of the present disclosure provide a divider system for a storage receptacle, including a plurality of elongate panels. Each panel may include a pair of bands of magnetic material, for example steel, extending along the length of the panel. Each panel may also include a pair of magnets located at each end and arranged to magnetically attract and attach to the pair of magnetic material bands when the end of a first panel is butted against the side of a second panel. The panels may optionally include a layer to cover the sides and/or ends of the panel, including the magnets and magnetic material bands, for example a veneer or other material. Panels may be different lengths and a uniform height to provide a desired configuration of sub-compartments within a storage receptacle, for example such as a drawer, a container, shelving, a cabinet, a vehicle console or trunk, or the like.

Referring to FIG. 1, an illustrative embodiment of a divider system 100 for use with a drawer 20 according to the present disclosure and includes elongate panels 102*a-h* of varying lengths 110 and uniform heights 112 (FIG. 3) to form sub-compartments 101*a-l* within the drawer 20. The various panels 102 include a bottom edge 108*a* that rests on a bottom 26 of the drawer 20 and the panels are sized and may be configured to span a portion of or the entire length 30 formed by the sides 22 and a portion of or the entire width 32 formed by the ends 24, thus enabling the user of the divider system 100 to configure sub-compartments 101*a-i* of varying sizes.

Figure 2:
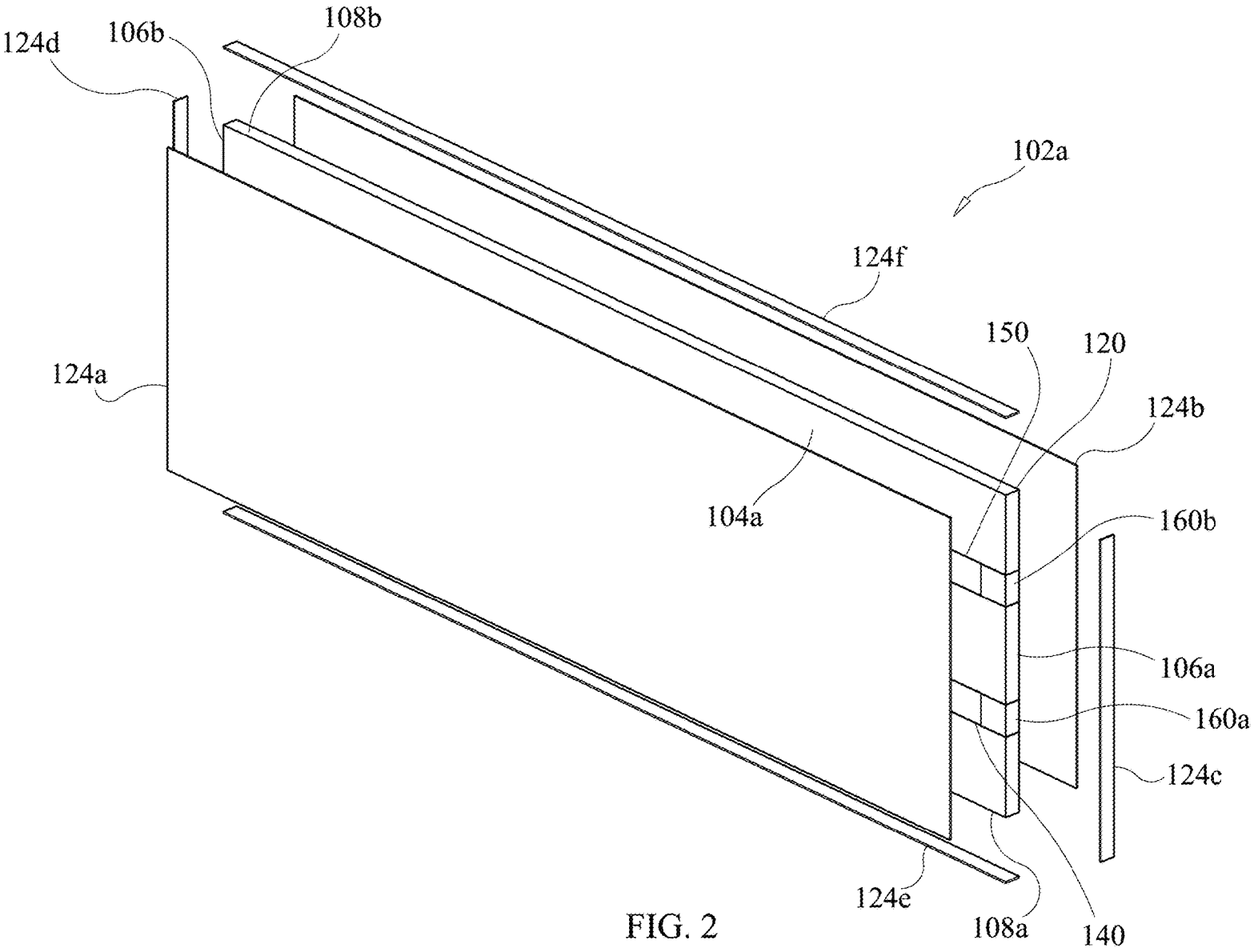
FIG. 2 is a partially exploded perspective view of a first elongate panel of the divider system of FIG. 1.
Figure 3:
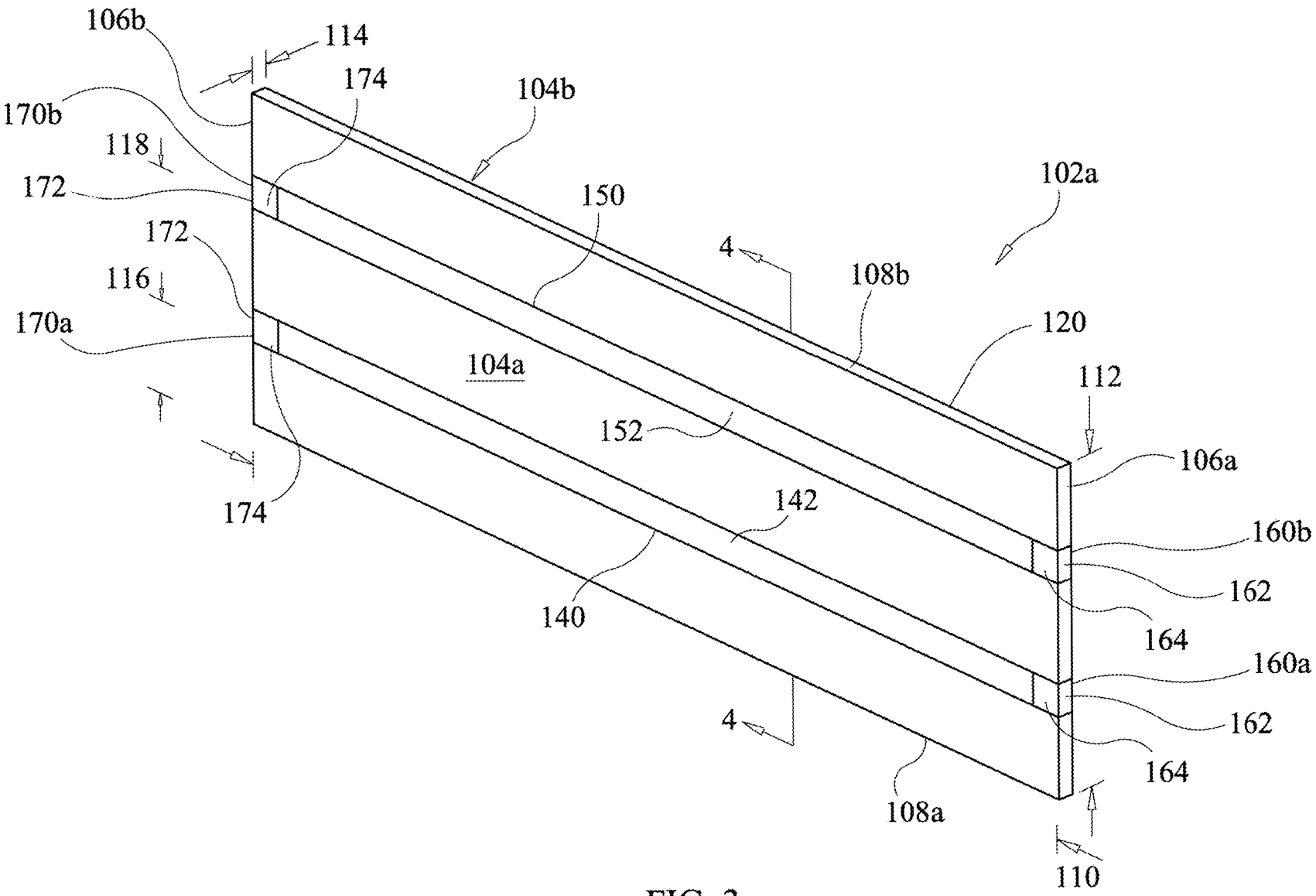
FIG. 3 is a portion of the first elongate panel shown in FIG. 2.

Referring to FIGS. 2 and 3, each panel 102*a* includes a board 120, a first band of magnetic material 140, a second band of magnetic material 150, a first magnet 160 *a-b*, a second magnet 170*a-b*, and cover layers 124*a-f*. As will be discussed further below, in some embodiments the various features other than the board 120 are optional and may be absent from the panel 102. FIG. 2 is a partially exploded view, illustrating optional cover layers 124*a-f* shown separated from the board 120. FIG. 3 illustrates panel 102*a* without any cover layers 124*a-f*.

Referring to FIG. 3, the first magnet 160*a-b* is positioned at a first end 106*a* of the panel 102*a* and may be formed by a single magnet spanning at least a portion of the height of the first end 106*a*, or may be formed by more than one magnet, for example, a pair of magnets 160*a-b* as shown. Similarly, the second magnet 170*a-b* is positioned at a first end 106*a* of the panel 102*a* and may be formed by a single magnet spanning at least a portion of the height of the second end 106*b*, or formed may be formed by more than one magnet, for example, a pair of magnets 170*a-b* as shown.

Figure 6:
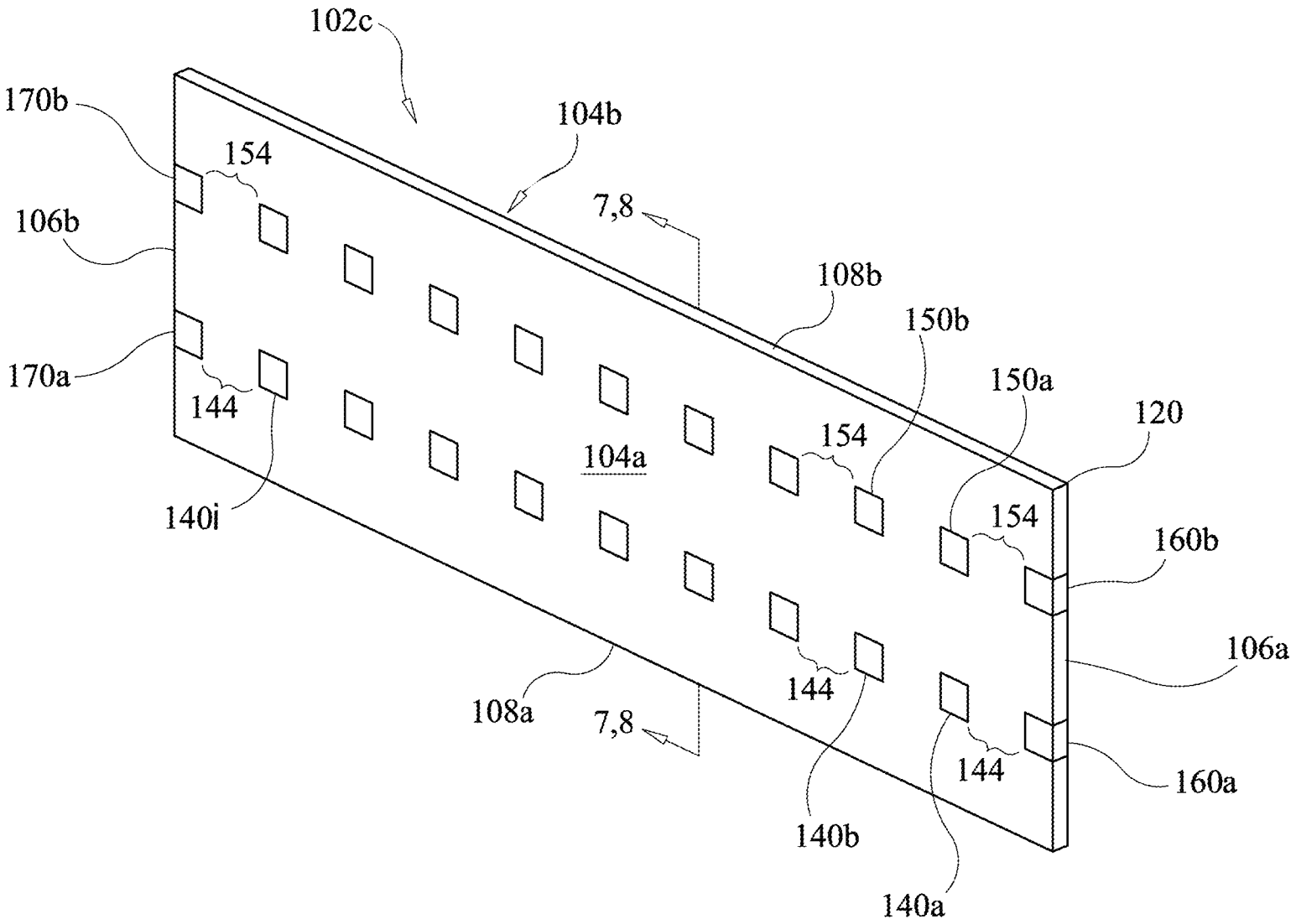
FIG. 6 is a perspective view of a third elongate panel of the divider system of FIG. 1.

The first band of magnetic material 140 spans between the first magnet 160*a* and the second magnet 170*a*. The first band of magnetic material 140 may abut both of the first magnet 160*a* and the second magnet 170*a*, or may define spaces 144 therebetween, for example, as shown for the panel 102*c* in FIG. 6. Advantageously, the first band of magnetic material 140 may be located at a first distance 116 from the bottom edge 108*a* of the panel 102*a*, for example, about one-third the height 112 of the panel.

Similarly, the second band of magnetic material 150 spans between the first magnet 160*b* and the second magnet 170*b*. The second band of magnetic material 150 may abut both of the first magnet 160*b* and the second magnet 170*b*, or may define spaces 154 therebetween, for example, as shown for the panel 102*c* in FIG. 6. Advantageously, the second band of magnetic material 150 may be located at a second distance 118 from the bottom edge 108*a* of the panel 102*a*, for example, about two-thirds the height 112 of the panel. The first band of magnetic material 140, the second band of magnetic material 150, the first magnets 160 *a-b*, and the second magnets 170*a-b* may be bonded to the board 120 using a permanent adhesive known in the art, for example, an epoxy resin, or alternatively may be simply embedded upon the forming of the board 120, for example, during injection molding or during a composite or other resin layup process.

In order to provide magnetic interlocking between a first panel 102*a* having a first end 106*b* abutting against the side 104*a* or 104*b* of a second panel 102, the first magnet 160*a-b* and second magnet 170*a-b* each span the first and second bands of magnetic material 140 and 150. Alternatively, as shown in FIG. 3, a first one of the magnets 160*a* and a first one of the magnets 170*a* can be located at the first distance 116 from the bottom edge 108*a* of the panel 102*a* and the second one of the magnets 160*b* and a second one of the magnets 170*b* can be located a second distance 118 from the bottom edge 108*a* of the panel 102*a*.

Figure 8:
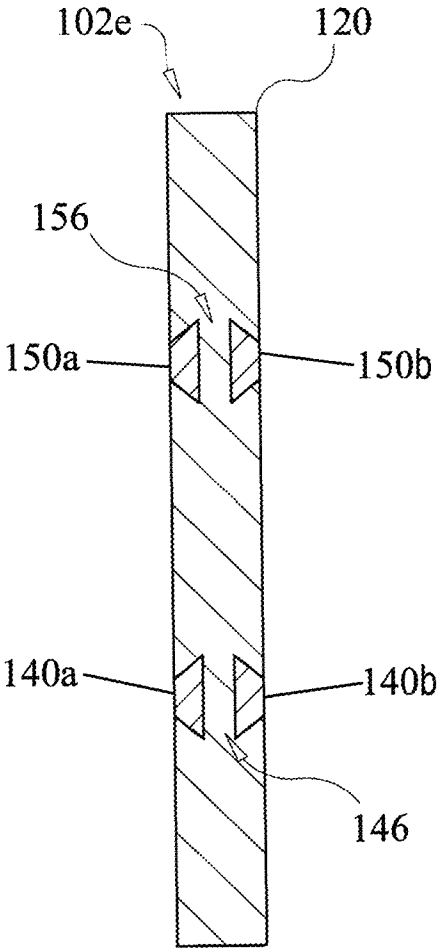
FIG. 8 is a vertical cross-sectional view of a second embodiment of the third elongate panel of FIG. 6, taken along section lines 8-8.
Figure 7:
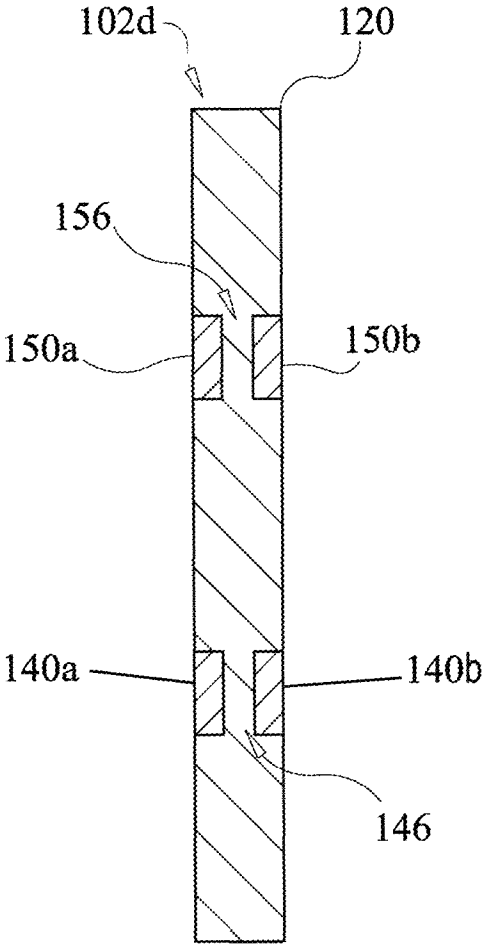
FIG. 7 is a vertical cross-sectional view of a first embodiment of the third elongate panel of FIG. 6, taken along section lines 7-7.
Figure 4:
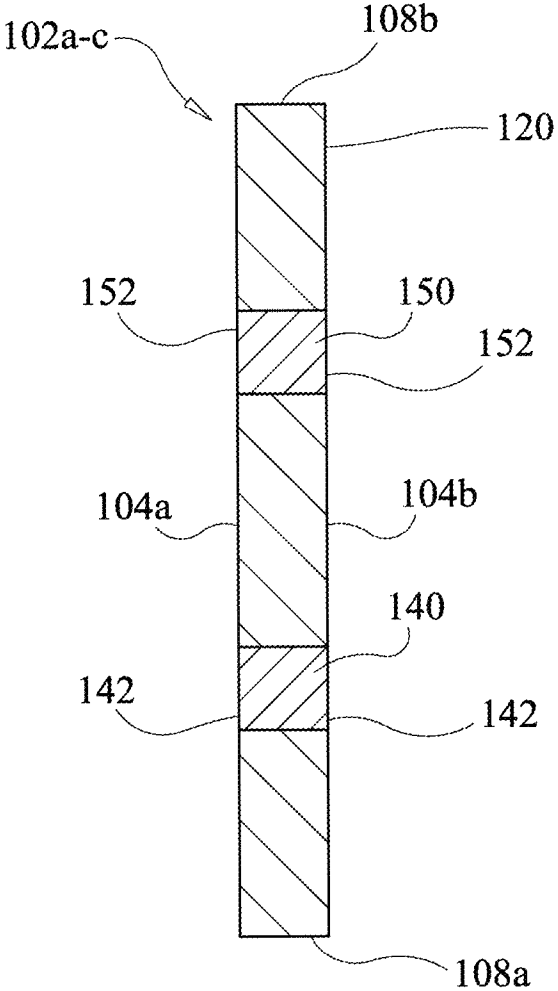
FIG. 4 is a vertical cross-sectional view of the first elongate panel of FIG. 3, taken along section lines 4-4.

Referring to the cross-sectional view illustrated in FIG. 4, for panels 102*a-c* each of the first and second bands of magnetic material 140 and 150 may span between opposite sides 104*a* and 104*b* of the board 120. Alternatively, as shown in FIGS. 7 and 8, for panels 102*d-e* each of the first bands 140 and 150 may include separate strips 140*a* and 140*b* and 150*a* and 150*b* associated with each of the sides 104*a-b*, respectively, the strips forming gaps 146 and 156, respectively, therebetween which may be filled by a portion of the board 120.

Regardless of the configuration of the first and second bands of magnetic material 140 and 150, the opposite surfaces 142 and 152 of each of the first and second bands of magnet material may be flush with the respective sides 104*a* and 104*b* as illustrated in FIGS. 3 and 4, thereby the board 120 and the first and second bands of magnetic material 140 and 150 define planar surfaces at the sides 104*a* and 104*b*. Similarly, some or all of the end surfaces 162 and 172 and the side surfaces 164 and 174 of the first and second magnets 160*a-b* and 170*a-b* may be flush with the respective ends 106*a* and 106*b* and sides 104*a* and 104*b*, thereby the board 120 and the magnets 160*a-b* and 170*a-b* defining planar surfaces at one or more of the sides 104*a* and 104*b* and ends 106*a* and 106*b*.

Planar surfaces enable an end 106*a* of a first panel 102*b* to fully abut a side 104*a* of a second panel 102*a*, thus enabling the most proximate positioning of magnets 160*a-b* of the first panel 102*b* with the first and second bands of magnetic material 140 and 150, as is illustrate in FIG. 1. Advantageously, as shown in FIG. 2, the first and second bands of magnetic material 140 and 150 may be continuous strips spanning between the first and second magnets 160*a-b* and 170*a-b*, thus enabling infinite adjustment of where along the side 104*a* of the second panel 102*a* the end 106*a* of the first panel 102*b* abuts, which along with varying lengths 110 of the panels 102*a-h*, enables the configuration of sub-compartments 101*a-i* of varying and desired sizes.

Referring to FIG. 2, the board 120, the first band of magnetic material 140, the second band of magnetic material 150, the first magnets 160 *a-b*, and the second magnets 170*a-b*, may be covered by optional cover layers 124*a-f*, for example, a non-magnetic material formed from a solid or composite layer such as veneer or a liquid layer such as a resin that hardens into a solid. Advantageously, the cover layers 124*a-f* may be decorative, as is the case with wood veneer, and/or may be for safety to encapsulate the first and second bands of magnetic material 140 and 150 and the first and second magnets 160*a-b* and 170*a-b* to prevent their inadvertent separation from the board 120. The cover layers 124*a-f* may be bonded to the boards 120, the first band of magnetic material 140, the second band of magnetic material 150, the first magnets 160 *a-b*, and the second magnets 170*a-b* with a permanent adhesive known in the art, for example, an epoxy resin.

In the illustrative embodiment, one or both of the edge cover layers 124*e-f* of the panel 102*a* may be formed from a friction material, for example rubber, silicone, or another material with a high surface co-efficient of friction. As the edge cover layers 124*e-f* are in contact with, i.e. rest upon, the bottom 26 of the drawer 20, the high surface co-efficient of friction aids in the panel 102*a* remaining in a fixed position after it is configured.

The board 120 of the panel 102*a* may be formed from one or more of a variety of alternative non-magnetic materials, including, but not limited to, bamboo or other woods, plastic, melamine or other resins, rubber, non-magnetic metal and metal alloys, laminates, and a composite material, none of which have a strong if any attraction to a magnetic field. The first and second bands of magnetic material 140 and 150 may be formed from one of a variety of alternative magnetic materials, including but not limited to ferromagnet materials, which have a strong magnetic permeability and thus providing a strong attraction to magnets to hold the panel 102*a* in position once configured. Thus, 'magnetic material' is understood to be those materials that are attracted to a magnetic field, including from a magnet, and which may or may not be magnetized. Such magnetic materials include, but are not limited to, iron, nickel, and cobalt and their alloys, alloys of rare-earth metals such as neodymium, and composites such as iron-oxide-containing ceramic material. While it is not required that the first and second bands of magnetic material 140 and 150 be magnetized to provide a persistent magnetic field, in some embodiments according to the present invention the first and second bands of the magnetic material 140 and 150 may be magnetized and the poles oriented upon coupling with the board 120 to interlock with the first and second magnets 160*a-b* and/or 170*a-b* of an abutting panel 102*b*.

The first and second magnets 160*a-b* and 170*a-b* may be formed from one of a variety of alternative magnet materials, including but not limited to ferromagnetic materials, which provide a strong persistent magnetic field upon being magnetized, including but not limited to iron, nickel, and cobalt and their alloys, alloys of rare-earth metals such as neodymium, magnetite, loadstone, and magnet composites such as iron-oxide-containing ceramic material. As discussed above for the first and second bands of magnetic material 140 and 150, the first and second magnets 160*a-b* and 170*a-b* optionally may also have the poles oriented upon coupling with the board 120 to interlock with the first and second bands of magnetic material 140 and 150.

Dimensionally, the panels 102*a-h* of the divider system 100 may be sized to accommodate the particular storage receptacle for which the system 100 is intended, and the desired range of sizes of sub-compartments 101*a-i*. For example, for drawer 20, typical lengths may be in the range of 6" to 24" and typical heights may be in the range of 2½" to 4". In one illustrative embodiment, the divider system 100 including panels 102*a-h* that includes panels of differing heights, and/or uniform lengths. The typical thickness of the panels 102*a-h* may be in the range of ⅛" to ½"; however, for all dimensions of the panels 102*a-h*, the range may vary outside of these typical ranges depending on the application and the desired range of sizes of sub-compartments 101*a-i*. The optional cover layers 124*a-d* are very thin to minimize the distance between the first magnet 160*a-b* and the second magnet 170*a-b* of the first panel 102*b* abutting with the corresponding first and second bands of magnetic material 140 and 150 of the second panel 102*a*, thereby minimizing a loss of strength of the magnetic field providing interlocking between adjacent panels 102 because of the separation caused by the interleaved cover layers 124*a-d*. For example, the thickness of cover layers 124*a-d* may be 1/32" or less.

Figure 5:
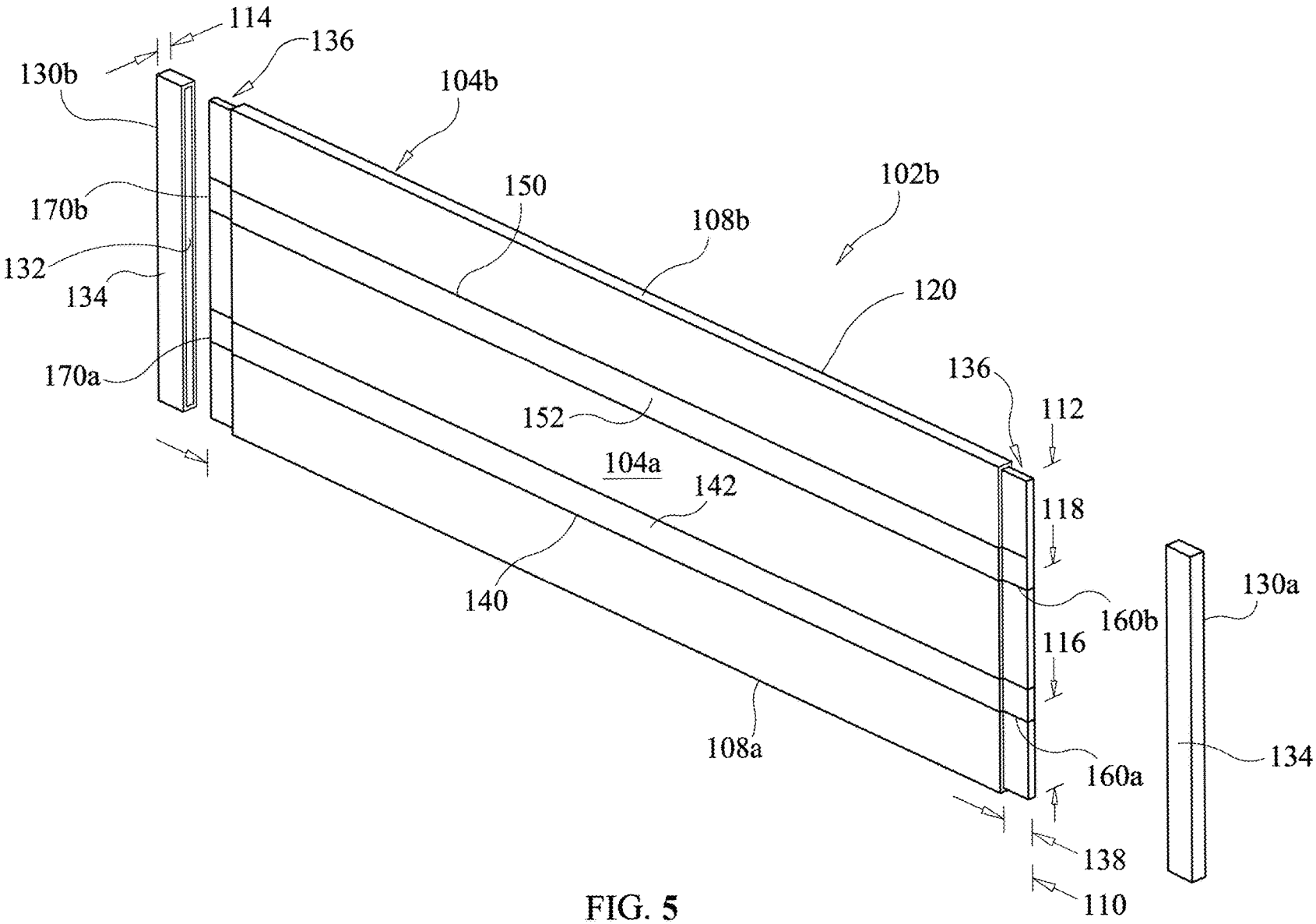
FIG. 5 is a partially exploded perspective view of a second elongate panel of the divider system of FIG. 1.

Referring to FIG. 5, another illustrative embodiment of a panel 102*b* is illustrated with end caps 130*a* and 130*b* shown partially exploded from the board 120. The panel 102*b* may share any of the characteristics discussed above and below for the illustrative embodiments of the panel 102*a, c-e*; however, the one difference evident in FIG. 5 for panel 102 *b* is the tongues 136 formed by a reduced thickness 114 and height 112 extending a short width 138 at opposite ends 106*a-b* so that recess 132 formed in end caps 130*a* and 130*b* may encapsulate the tongues 136 and the magnets 160*a-b* and 170*a-b*.

Advantageously, the tongues 136 and end caps 130*a-b* can be optionally sized so that the sides 134 of the end caps 130*a-b* to be co-planar with the sides 104*a-b* of the board 120. The width 138 of the tongues 136 may be the same as that of the magnets 160*a-b* and 170*a-b* embedded in the tongues. The endcaps may be bonded to the board 120 and magnets 160*a-b* and 170*a-b* using a permanent adhesive known in the art, for example, an epoxy resin. Advantageously, the endcaps provide an alternative to cover layers 124*a-d* to provide ornamentation and/or to provide safety encapsulation of magnets 160*a-b* and 170*a-b*.

In contrast to the continuous strips of the first band and the second band of magnetic material 140 and 150 as illustrated in FIG. 3, another illustrative embodiment of panel 102*c* the first band of magnetic material 140 is formed by a number of periodically spaced segments 140*a-i* of magnetic material with spaces 144 lacking magnetic material defined therebetween. Similarly, the second band of magnetic material 150 is formed by a number of periodically spaced segments 150*a-i* of magnetic material with spaces 154 lacking magnetic material defined therebetween. Corresponding members of the periodically spaced segments 140*a* and 150*a* through 140*i* and 150*i* are in vertical alignment so the an end 106*a-b* of another panel 102*a-h* and its associated magnets 160*a-b* or 170*a-b* may be abutted against a side 104*a-b* of the panel 102*c* at any of the locations at which a pair of periodically spaced segments 140*a-i* and 150*a-i* are located, thus provided a numerous, albeit not infinite, options for configuring two adjacent panels 102*c* and 102*a-h*. The periodically spaced segments 140*a-i* and 150*a-i* may extend to both sides 104*a-b* of the panel 102*c*, for example, as shown for panel 102*a-c* in FIG. 4, or may be formed as a separate segment flush with each side 104*a-b* of the board 120, with gaps 146 and 156 formed therebetween, as shown in FIGS. 7 and 8.

The cross-sectional shape of the first and second band of magnetic material 140 and 150, whether a continuous strip, periodically spaced segments, and/or separate segments flush with each side of 104*a-b*, may vary as understood by comparing cross-sectional views of FIGS. 4 and 7-8, including cross-sections that are square, rectangular, trapezoidal, round (not shown), or other geometric shapes. Referring to FIGS. 3-4, if the surfaces 142 and 152 of the magnetic material 140 and 150 that are flush with a side 104*a-b* of the panel 102*a-h* is other than flat, then the corresponding surface 162 of the magnets 160*a-b* and 170*a-b* must be of a complementary shape so that the magnetic field provides a strong interlock by lacking air gaps therebetween.

Figure 10:
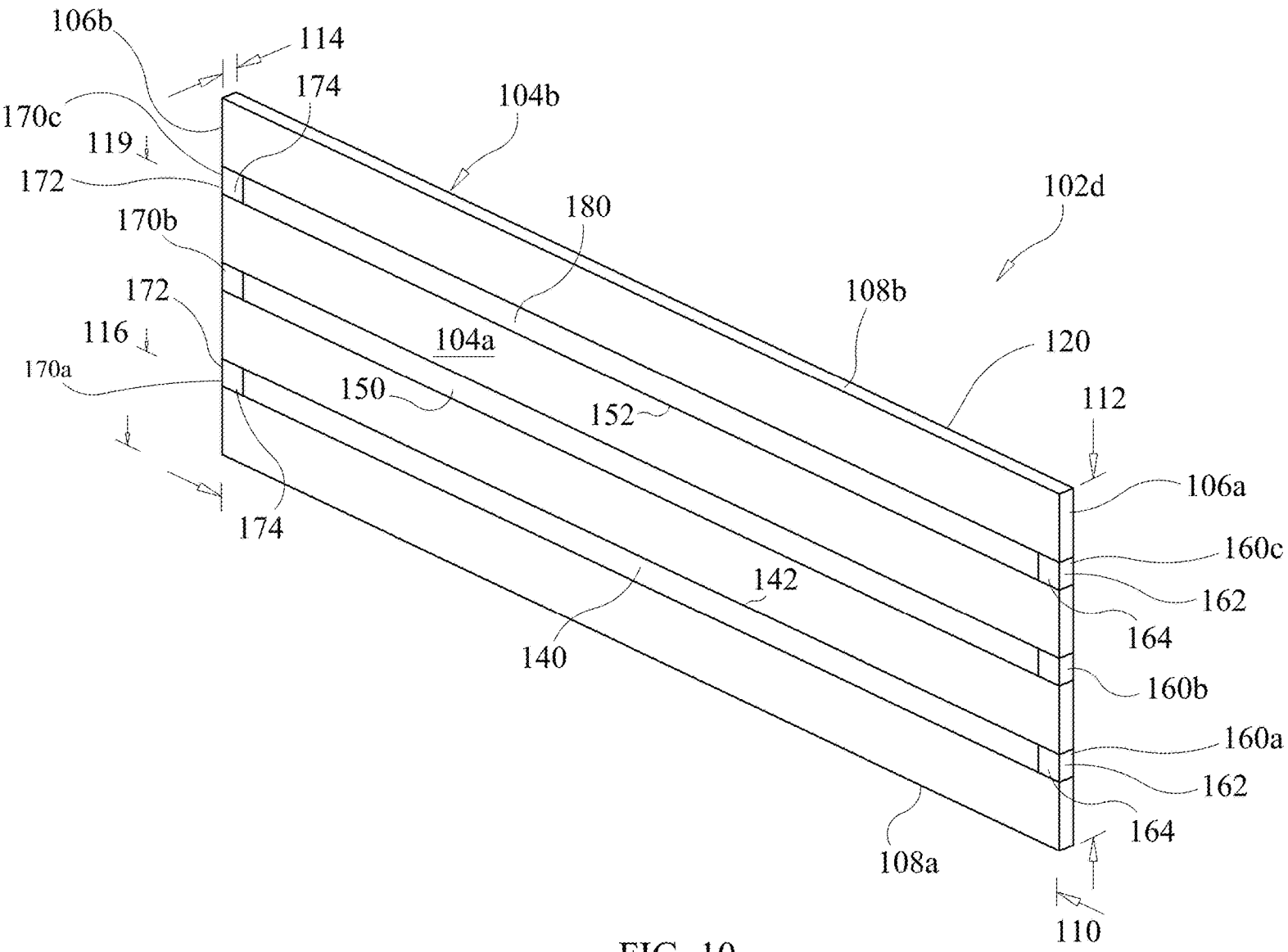
FIG. 10 is a perspective view of a an alternative embodiment of an elongate panel according to the present disclosure.

In another alternative embodiment of the panels 102*a-h* show in FIG. 10, a third band of magnetic material 180, whether continuous or formed from periodically spaced segments may be included at a third distance from an edge 108*a* of the board 120, for example, for a panel 102*a-h* having a greater height and/or to provide a stronger interlock between adjacent panels by adding an additional pairing of a band of magnetic material and magnet. Similarly, in another alternative embodiment one or more of the panels 102*a-h* may have more than two bands of magnetic material, i.e., any number of bands, whether continuous or formed from periodically spaced segments.

Figure 9:
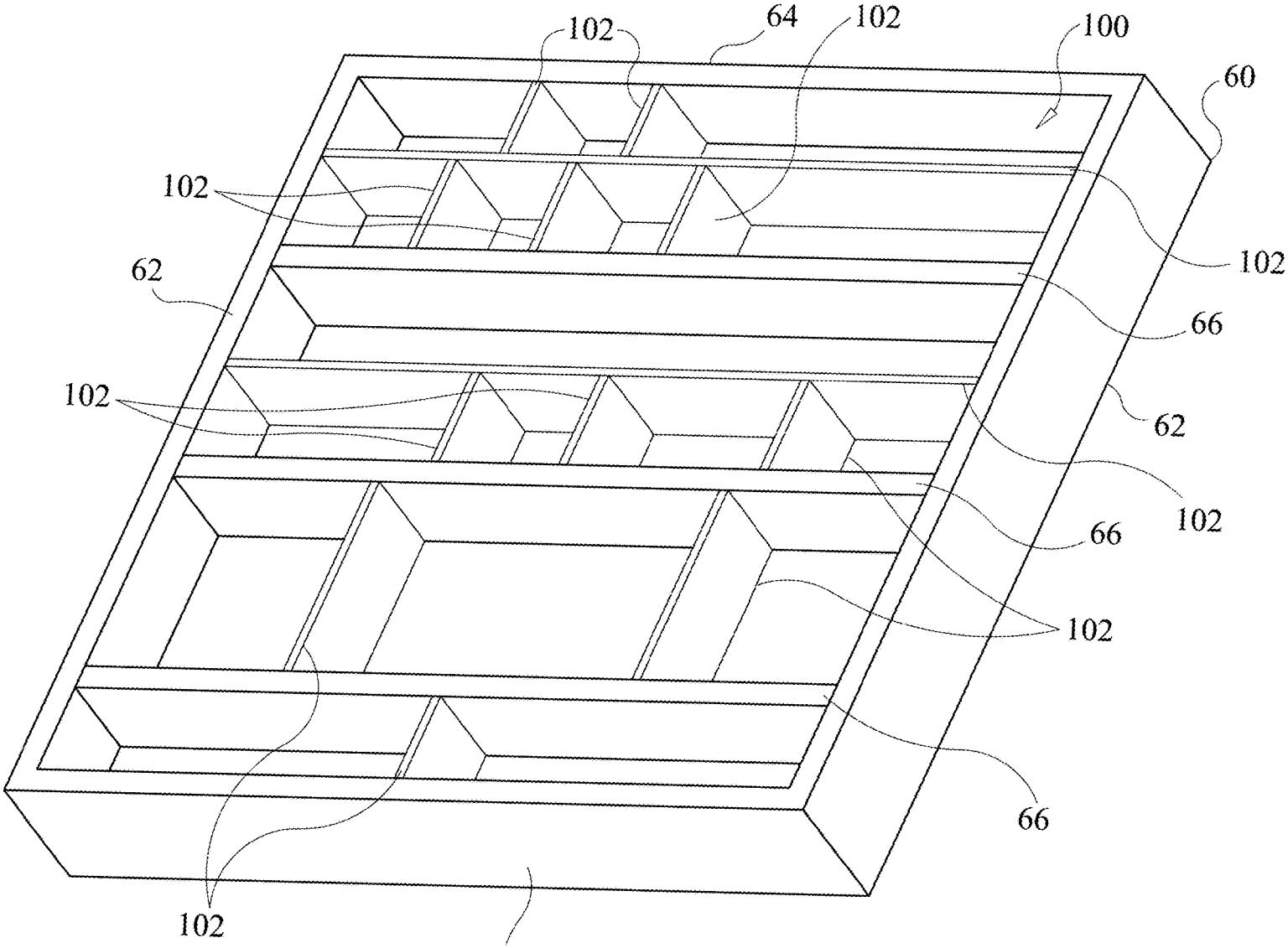
FIG. 9 is perspective view of a second embodiment of the divider system in use with a shelving storage receptacle that is adapted for use with the divider system.

Referring to FIG. 9, an illustrative embodiment of a divider system 100 for use with shelves 60 according to the present disclosure includes elongate panels 102 of varying lengths 110 and uniform heights 112 (FIG. 3), for example to match the depth of each individual shelf 66, to form sub-compartments within the shelves 66, sides 62, and ends 64. The panels 102 of the divider system for the shelves 60 may include a combination of any of the above features discussed for panels 102*a-h* for the drawer 20 above.

Referring to FIG. 1, the drawer 20 optionally can be specially adapted for use with the divider system 100. Specifically, the sides 22 and ends 24 of the drawer may include bands 28*a* and 28*b* of magnetic material for magnetic interlocking with the magnets 160*a-b* and 170*a-b* of panels 102*a-h*. The bands of magnetic material 28*a* and 28*b* may be formed as and located, bonded, and/or encapsulated with sides 22 and ends 24 of the drawer 20 with any of the same features as disclosed for board 120 of the panels 102*a-h*. Alternatively, the bands of magnetic material 28*a* and 28*b* may be attached to the surface of the sides 22 and ends 24, rather than recessed within the sides and ends as for the board 120 of the panels 102*a-h*. Although the storage receptacles illustrated and described in detail herein were only a drawer 20 and shelves 60, the divider system 100 may be used with any storage receptacle, for example such as a drawer, a container, shelving, a cabinet, a vehicle console or trunk, or the like. Additionally, any such storage receptacles may be specially adapted for use with the divider system 100, including incorporating the bands of magnetic material 28*a* and 28*b* as shown in FIG. 1 for the drawer 20.

Reference systems that may be used herein can refer generally to various directions (e.g., upper, lower, forward and rearward), which are merely offered to assist the reader in understanding the various embodiments of the disclosure and are not to be interpreted as limiting. Other reference systems may be used to describe various embodiments.

While examples, one or more representative embodiments and specific forms of the disclosure have been illustrated and described in detail in the drawings and foregoing description, the same is to be considered as illustrative and not restrictive or limiting. The description of particular features in one embodiment does not imply that those particular features are necessarily limited to that one embodiment. Some or all of the features of one embodiment can be used or applied in combination with some or all of the features of other embodiments unless otherwise indicated. One or more exemplary embodiments have been shown and described, and all changes and modifications that come within the spirit of the disclosure are desired to be protected.

ELEMENT NUMBERING

Table 1 includes reference numerals and at least one word used to describe the member and/or feature represented by the reference numeral. It is understood that none of the embodiments disclosed herein are limited to these descriptions, other words may be used in the description or claims to describe a similar member and/or feature, and these reference numerals can be described by other words that would be understood by a person of ordinary skill reviewing this disclosure in its entirety.

| | |
|---|---|
| 20 | Drawer |
| 22 | Side |
| 24 | End |
| 26 | Bottom |
| 28a-b | magnetic material band |
| 30 | Length |
| 32 | Width |
| 60 | shelves |
| 62 | side |
| 64 | end |
| 66 | shelf |
| 100 | divider system |
| 102a-h | panel |
| 104a-b | side |
| 106a-b | end |
| 108a-b | edge |
| 110 | length |
| 112 | height |
| 114 | thickness |
| 116 | first distance |
| 118 | second distance |
| 120 | board |
| 124a-f | cover layer |
| 130 | end cap |
| 132 | recess cap |
| 134 | side |
| 136 | tongue |
| 138 | length |
| 140a-i | first band magnetic material |
| 142 | surface |
| 144 | space |
| 146 | gap |
| 150a-i | second band magnetic material |
| 152 | surface |
| 154 | space |
| 156 | gap |
| 160a-b | first magnet |
| 162 | end surface |
| 164 | side surface |

-continued

| | |
|---|---|
| 170 | second magnet |
| 172 | end surface |
| 174 | side surface |

What is claimed is:

1. A divider system for a storage receptacle, comprising a plurality of elongate panels; and wherein each of the plurality of elongate panels includes:

a first band of magnetic material extending along the length of each of the plurality of elongate panels at a first distance from a bottom edge of each of the plurality of elongate panels;

a second band of magnetic material extending along the length of each of the plurality of elongate panels at a second distance from the bottom edge of each of the plurality of elongate panels;

at least a first magnet located at a first end of each of the plurality of elongate panels and positioned to magnetically attract at least one of the first band and the second band of magnetic material of a first one of the plurality of elongate panels; and at least a second magnet located at a second end of each of the plurality of elongate panels and positioned to magnetically attract at least one of the first band and the second band of magnetic material of a second one of the plurality of elongate panels; and wherein;

at least one of the first band and the second band of magnetic material includes a first end that abuts the first magnet, and at least one of the first band and the second band of magnetic material includes a second end that abuts the second magnet, and a third one of the plurality of elongate panels positioned perpendicular to the first one and the second one of the plurality of elongate panels with the first end abutted against a side of the first one of the plurality of elongate panels and the second end abutted against a side of the second one of the plurality of elongate panels, the first one, the second one, and the third one of the plurality of elongate panels are magnetically retained in their relative positions to form a storage sub-compartment barrier within the storage receptacle; and thereby enabling relative positions of the third panel to include having the first end abutted to and magnetically coupled with each one of:

the first end of the first one of the plurality of elongate panels, the second end of the first one of the plurality of elongate panels, and a plurality of positions between the first end and the second end of the first one of the plurality of elongate panels.

2. The divider system of claim 1, wherein:

the at least a first magnet includes a first pair of magnets, a first one of the first pair of magnets positioned at the first distance from the bottom edge of each of the plurality of elongate panels, and the second one of the first pair of magnets positioned at the second distance from the bottom edge of each of the plurality of elongate panels; and the at least a second magnet includes a second pair of magnets, a first one of the second pair of magnets positioned at the first distance from the bottom edge of each of the plurality of elongate panels and a second one of the second pair of magnets positioned at the second distance from the bottom edge of each of the plurality of elongate panels.

3. The divider system of claim 1, wherein the plurality of elongate panels are of uniform height, uniform thickness, and varying lengths.

4. The divider system of claim 1, wherein the first distance is about one-third of the height of the first one of the plurality of elongate panels.

5. The divider system of claim 1, wherein the second distance is about two-thirds of the height of the first one of the plurality of elongate panels.

6. The divider system of claim 1, wherein at least one of the first band and the second band of magnetic material comprises a continuous strip of magnetic material.

7. The divider system of claim 1, wherein at least one of the first band and the second band of magnetic material extends to opposites sides of each of the plurality of elongate panels.

8. The divider system of claim 1, wherein:

the first band and the second band of the magnetic material are recessed within each of the plurality of elongate panels; and each of the plurality of elongate panels defines opposite sides that are each planar and a surface of the first band and a surface of the second band of the magnetic material are flush with their respective opposite side.

9. The divider system of claim 1, wherein:

the at least a first magnet and the at least a second magnet are recessed within opposite ends of each of the plurality of elongate panels; and each of the plurality of elongate panels defines opposite ends that are each planar and a surface of the at least a first magnet and a surface of the at least a second magnet are each flush with their respective opposite end.

10. The divider system of claim 1, wherein the first band and the second band of magnetic material are magnetized to provide a persistent magnetic field.

11. The divider system of claim 1, wherein the at least a first magnet and the at least a second magnet of the first one of the plurality of elongate panels are oriented to magnetically attract the first band and the second band of magnetic material of the second one of the plurality of elongate panels.

12. The divider system of claim 1, wherein each of the plurality of elongate panels includes a cover layer spanning at least one of a side and an end of each of the plurality of elongate panels.

13. The divider system of claim 12, wherein the cover layer is a veneer.

14. The divider system of claim 12, wherein the cover layer spans at least the first band and the second band of magnetic material.

15. The divider system of claim 1, wherein each of the plurality of elongate panels includes an end cap enclosing the at least the first magnet at the first end.

16. The divider system of claim 1, wherein each of the plurality of elongate panels includes a friction layer spanning a bottom edge of each of plurality of elongate panels.

17. The divider system of claim 1, wherein the first one of the plurality of elongate panels includes a third band of magnetic material extending along the length of the first one of the plurality of elongate panels at a third distance from a bottom edge of the first one of the plurality of elongate panels.

18. A divider system for a storage receptacle, comprising a plurality of elongate panels; and wherein each of the plurality of elongate panels includes:

a first band of magnetic material extending along the length of each of the plurality of elongate panels at a first distance from a bottom edge of each of the plurality of elongate panels;

a second band of magnetic material extending along the length of each of the plurality of elongate panels at a second distance from the bottom edge of each of the plurality of elongate panels;

a first pair of magnets, a first one of the first pair of magnets positioned at the first distance from the bottom edge of each of the plurality of elongate panels, and the second one of the first pair of magnets positioned at the second distance from the bottom edge of each of the plurality of elongate panels; and a second pair of magnets, a first one of the second pair of magnets positioned at the first distance from the bottom edge of each of the plurality of elongate panels and a second one of the second pair of magnets positioned at the second distance from the bottom edge of each of the plurality of elongate panels; and wherein:

the first band and the second band of the magnetic material are recessed within each of the plurality of elongate panels;

each of the plurality of elongate panels defines opposite sides that are each planar and a surface of the first band and a surface of the second band of the magnetic material are flush with their respective opposite side;

the first pair of magnets and the second pair of magnets are recessed within their respective opposite end of each of the plurality of elongate panels; and each of the plurality of elongate panels defines opposite ends that are each planar and surfaces of the first pair of magnets and surfaces of the second pair of magnets are each flush with their respective opposite end.

19. The divider system of claim 18, wherein each of the plurality of elongate panels includes a cover layer spanning at least one of a side and an end of each of the plurality of elongate panels.

20. A divider system for a storage receptacle, comprising a plurality of elongate panels; and wherein:

a first one of the plurality of elongate panels includes:

a first band of magnetic material extending along the length of the first one of the plurality of elongate panels at a first distance from a bottom edge of the first one of the plurality of elongate panels; and a second band of magnetic material extending along the length of the first one of the plurality of elongate panels at a second distance from the bottom edge of the first one of the plurality of elongate panels; and a second one of the plurality of elongate panels includes:

at least a first magnet located at a first end of the second one of the plurality of elongate panels and positioned to magnetically attract at least one of the first band and the second band of magnetic material of a first one of the plurality of elongate panels; and at least a second magnet located at a second end of the second one of the plurality of elongate panels and positioned to magnetically attract at least one of the first band and the second band of magnetic material of a second one of the plurality of elongate panels; and wherein:

the first band and the second band of the magnetic material are recessed within the first one of the plurality of elongate panels;

each of the plurality of elongate panels defines opposite sides that are each planar and a surface of the first band and a surface of the second band of the magnetic material are flush with their respective opposite side;

the first pair of magnets and the second pair of magnets are recessed within their respective opposite end of the second one of the plurality of elongate panels;

each of the plurality of elongate panels defines opposite ends that are each planar and surfaces of the first pair of magnets and surfaces of the second pair of magnets are each flush with their respective opposite end; and the second one of the plurality of elongate panels positioned perpendicular to the first one of the plurality of elongate panels with the first end abutted against a side of the first one of the plurality of elongate panels, the first one and the second one of the plurality of elongate panels are magnetically retained in their relative positions to form a storage sub-compartment barrier within the storage receptacle.

* * * * *